US005261197A

United States Patent [19]

Pickle, Sr.

[11] Patent Number: 5,261,197

[45] Date of Patent: Nov. 16, 1993

[54] JAIL CELL CONSTRUCTION

[76] Inventor: William H. Pickle, Sr., Box 650, Gossett Rd., Sevierville, Tenn. 37862

[21] Appl. No.: 807,252

[22] Filed: Dec. 12, 1991

[51] Int. Cl.[5] ..... E04H 3/08

[52] U.S. Cl. ..... 52/106; 52/79.1

[58] Field of Search ..... 52/79.1, 79.2, 106, 52/127.1, 127.7, 127.8, 280, 281, 34, 64

[56] References Cited

U.S. PATENT DOCUMENTS 3,766,574 10/1973 Smid, Jr. ..... 52/34 X 4,599,829 7/1986 DiMartino, Sr. ..... 52/106 X

FOREIGN PATENT DOCUMENTS 2370134 7/1978 France ..... 52/34

*Primary Examiner*—Carl D. Friedman

*Assistant Examiner*—Creighton Smith

*Attorney, Agent, or Firm*—Michael E. McKee

[57] ABSTRACT

A cubic jail cell including a front wall, two opposite sidewalls, a back wall, a floor and a ceiling is modular in construction accommodating use of the cell by itself or with a group of cells of like construction. The back wall of the cell includes an opening, and the cell further includes a facility unit including a panel to which lavatory facilities are attached. The panel of the facility unit is securable to the back wall of the cell so as to cover the opening therein and so that when the facility unit is secured into place, the lavatory facilities are positioned within the interior of the cell. Couplings associated with the lavatory facilities accommodate attachment of the facilities to water and sewage pipes routed to the cell and are accessible from the exterior of the cell.

18 Claims, 6 Drawing Sheets

JAIL CELL CONSTRUCTION

BACKGROUND OF THE INVENTION

This invention relates generally to the confinement of prisoners and relates, more particularly, to the construction of jail cells.

It is not uncommon in a governmental jurisdiction that the number of prisoners sentenced to jail in that jurisdiction outnumbers the number of cell spaces available to suitably house those prisoners. It would therefore be desirable to provide a jail cell whose construction enables the cell to be used by itself or grouped together with cells of like construction to facilitate the growth of jail facility spaces needed to suitably house prisoners.

Another concern involving the housing of prisoners relates to the occasional maintenance required of lavatory facilities (i.e., the toilet and sink) of jail cells. If, for example, the toilet or sink within the cell becomes damaged or stopped-up, maintenance personnel may be required to enter the cell in order to make appropriate repairs. Of course, by entering the cell within which a dangerous individual is contained, the maintenance personnel may be exposed to danger. It would therefore be desirable to provide a jail cell construction whose lavatory facilities may be maintained or repaired outside of the cell.

Accordingly, it is an object of the present invention to provide a new and improved jail cell whose construction enables the cell to be used by itself or grouped together with cells of like construction.

Another object of the present invention is to provide such a jail cell which can be stored until needed, moved between two sites for use or returned to storage when not needed.

Still another object of the present invention is to provide such a cell which can be constructed at a site remote of the site where the cell is ultimately used.

A further object of the present invention is to provide such a cell having lavatory facilities that can be maintained or repaired outside of the jail cell.

A still further object of the present invention is to provide such a cell which is uncomplicated in construction and effective in operation.

SUMMARY OF THE INVENTION

This invention resides in a jail cell including means providing a front wall having a door, two opposite side walls, a back wall, a floor, and a ceiling. The cell also includes a facilities unit including a two-sided panel and at least one lavatory facility supportedly attached to one side of the panel and connection means associated with the lavatory facility for operatively joining the lavatory facility to water and sewage piping routed to the cell. The connection means are accessible from the side of the panel opposite the one panel side. At least one of the sidewalls and the back wall of the cell includes an opening across which the panel of the facilities unit is removably securable so that when the panel is secured across the opening, the lavatory facility is situated within the interior of the cell and the connection means are accessible from the exterior of the cell.

Because the cell is modular in construction, it may be grouped with cells of like construction in a security facility. Moreover, the self-contained nature of the cell accommodates an enlargement of a security facility by the addition of cells thereto and accommodates a reduction in the size of a facility by the removal of cells therefrom. If desired, the cells can be constructed at a site remote of the site at which the cell is ultimately used and, if desired, stored with or stacked upon cells of like construction until ready for use. Still further, because the facility unit of the cell may be removed from the remainder of the cell, maintenance personnel need not enter the cell to maintain the lavatory facility associated therewith.

DETAILED DESCRIPTION OF AN ILLUSTRATED EMBODIMENT

Turning now to the drawings in greater detail, there is illustrated in FIG. 1–4 a security facility 20 within which a plurality of jail cells 22 are incorporated. Each jail cell 22 includes features of the present invention and, as will be apparent herein, are modular in construction so that the facility can be expanded by adding cells 22 of like construction to the arrangement of cells in the facility 20. Similarly, the facility 20 can be reduced in size by removing one or more cells 22 from the cell arrangement.

Figure 2:
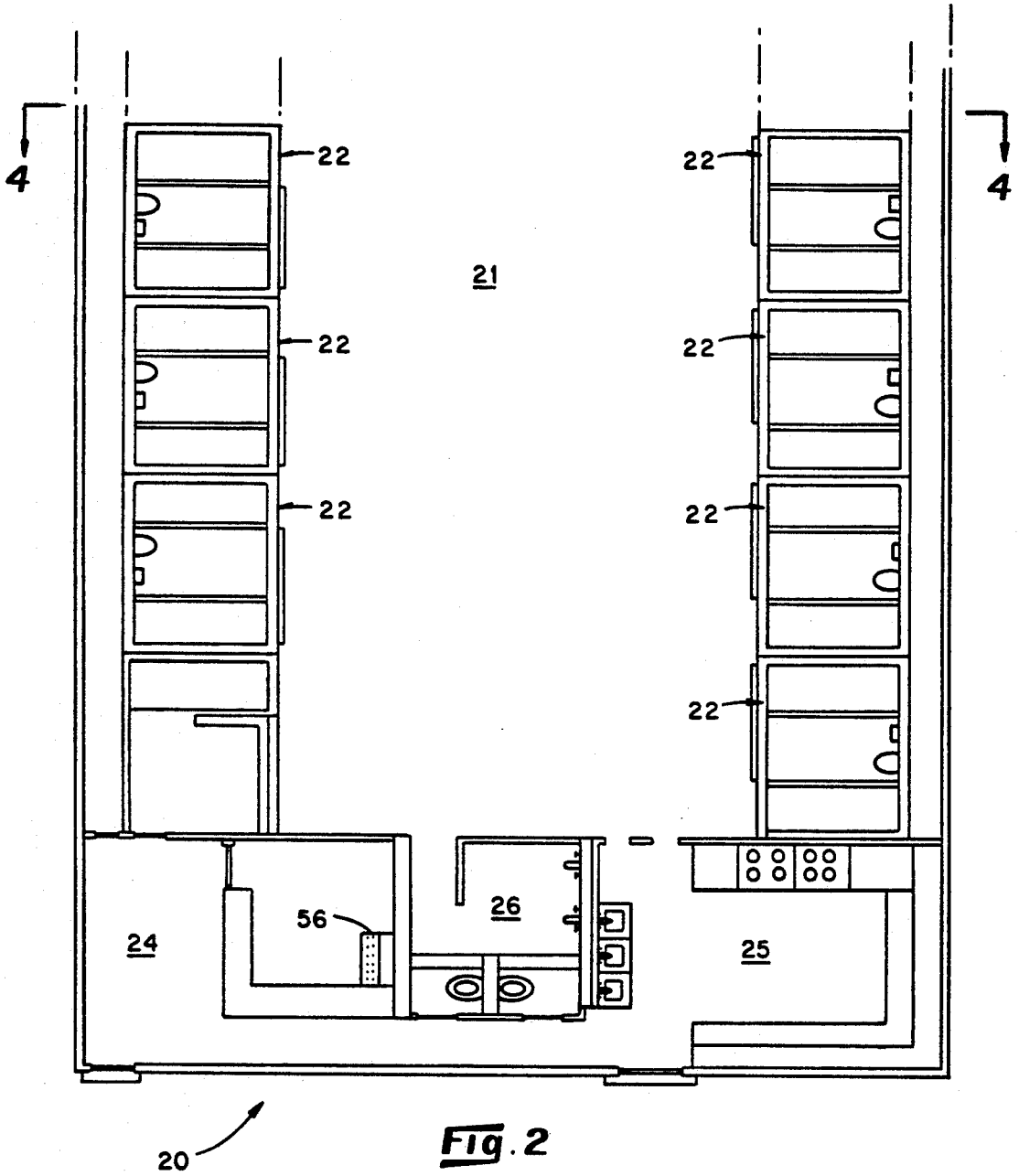
FIG. 2 is a fragmentary cross-sectional view taken about along line 2—2 of FIG. 1 illustrating the floor plan of the FIG. 1 security facility.
Figure 3:
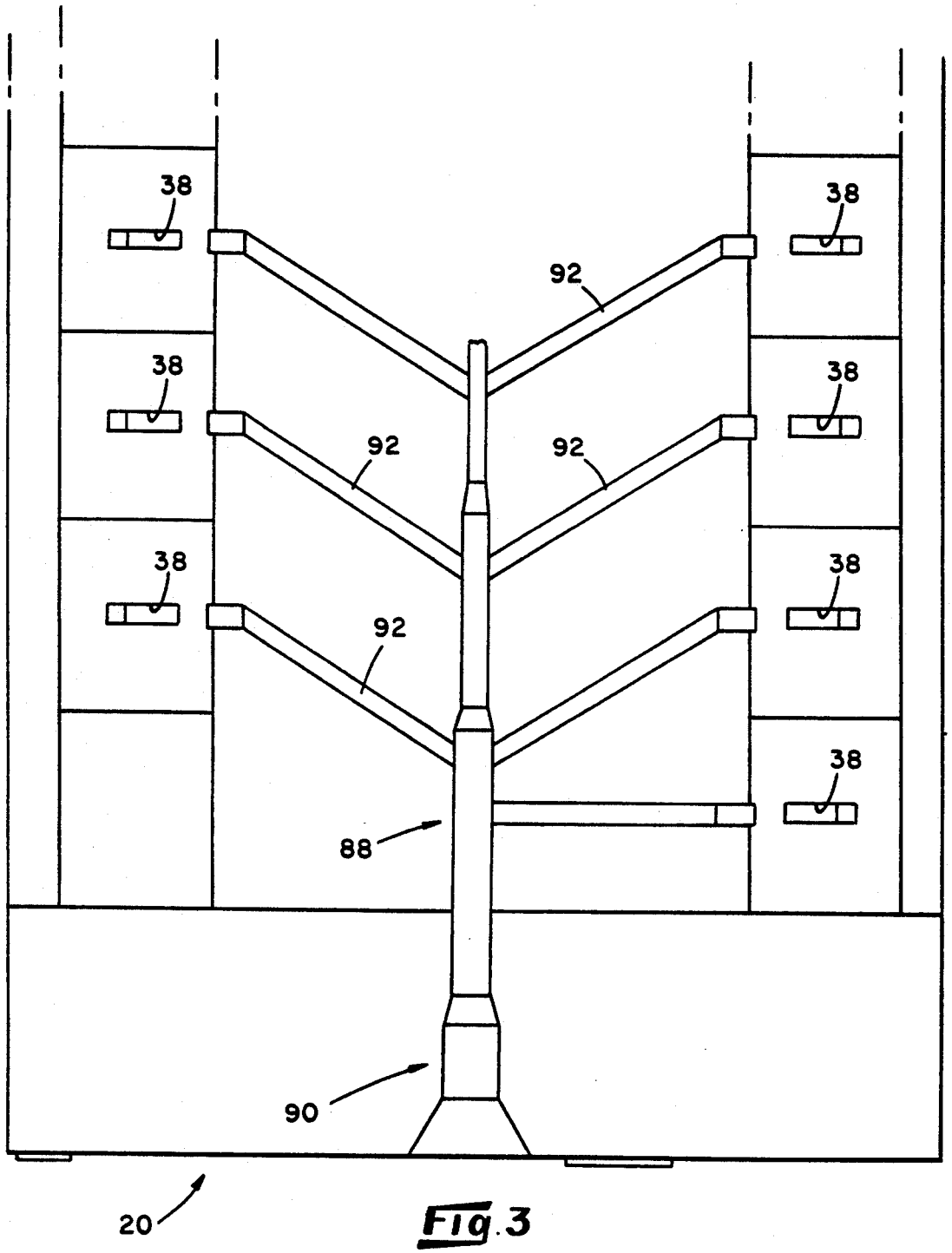
FIG. 3 is a fragmentary cross-sectional view taken about along line 3—3 of FIG. 1 illustrating the ductwork associated with the heat and ventilation system of the FIG. 1 facility.

As best shown in FIG. 2, the cells 22 of the facility 20 are arranged in two rows with a common area 21 between the rows. Adjacent one end of the facilities 20 there is provided an office area 24 and a kitchen area 25 joined by a shower area 26. In the broader interests of this invention, however, cells 22 may be used in conjunction with other types of areas, such as recreational or library areas. Accordingly, the principles of the present invention may be variously applied.

Figure 1:
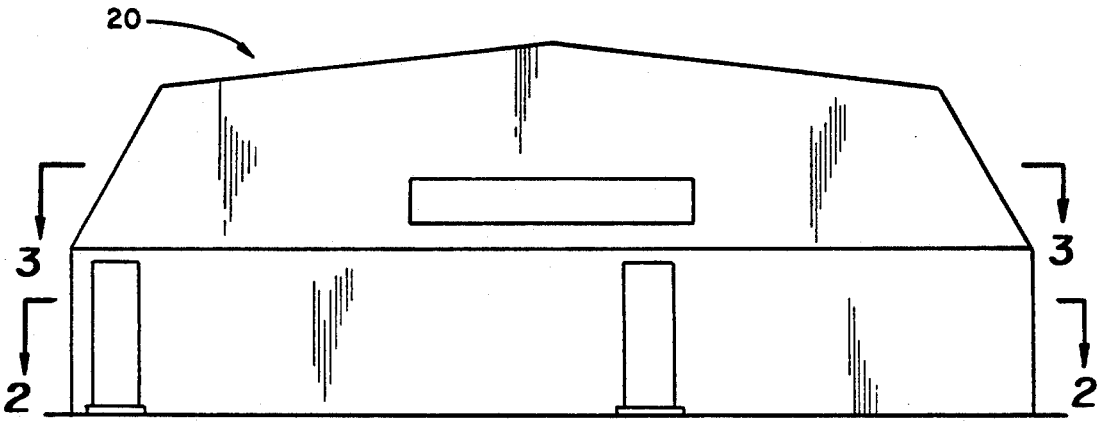
FIG. 1 is a front elevation view of an exemplary security facility including jail cells within which features of the present invention are incorporated.
Figure 4:
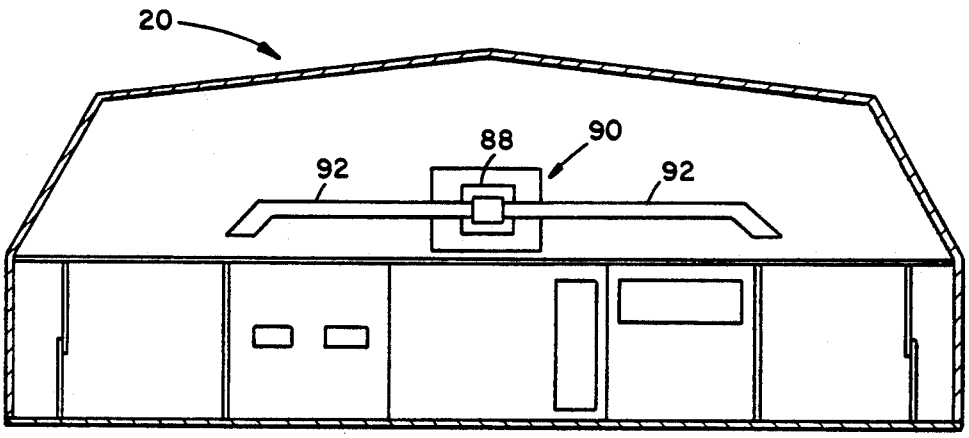
FIG. 4 is a cross-sectional view taken about along line 4—4 of FIG. 2.
Figure 5:
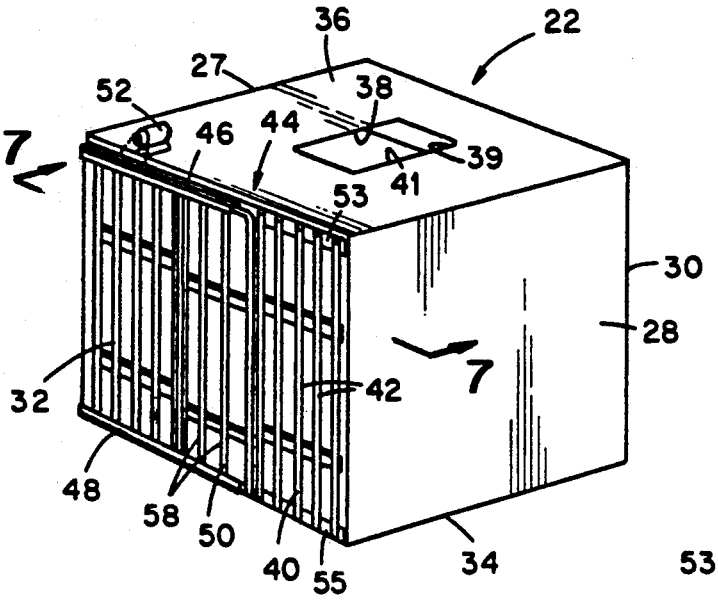
FIG. 5 is a perspective view of a jail cell embodied within the FIG. 1 facility.
Figure 6:
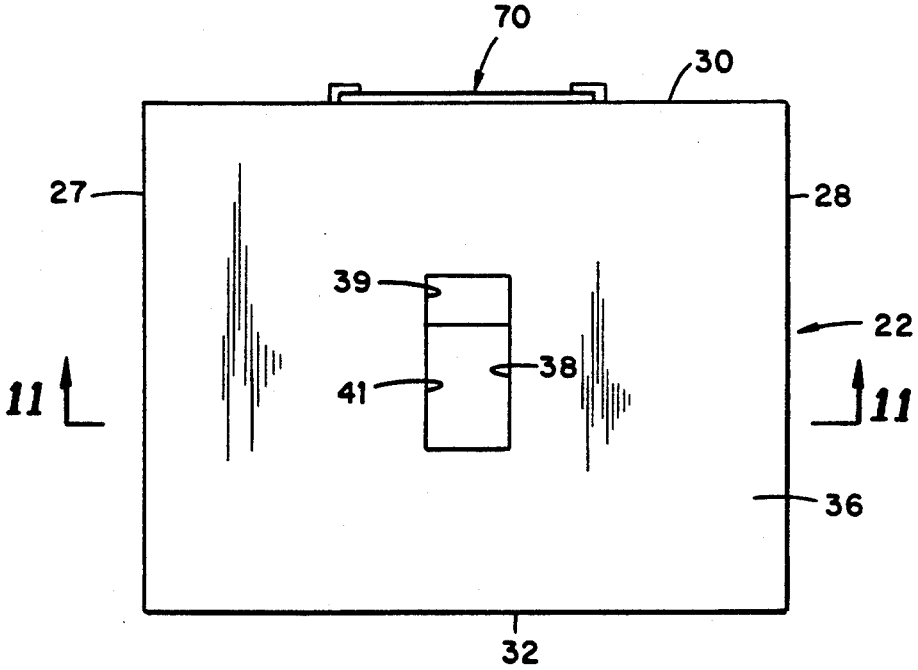
FIG. 6 is a top plan view of the FIG. 5 cell.
Figure 7:
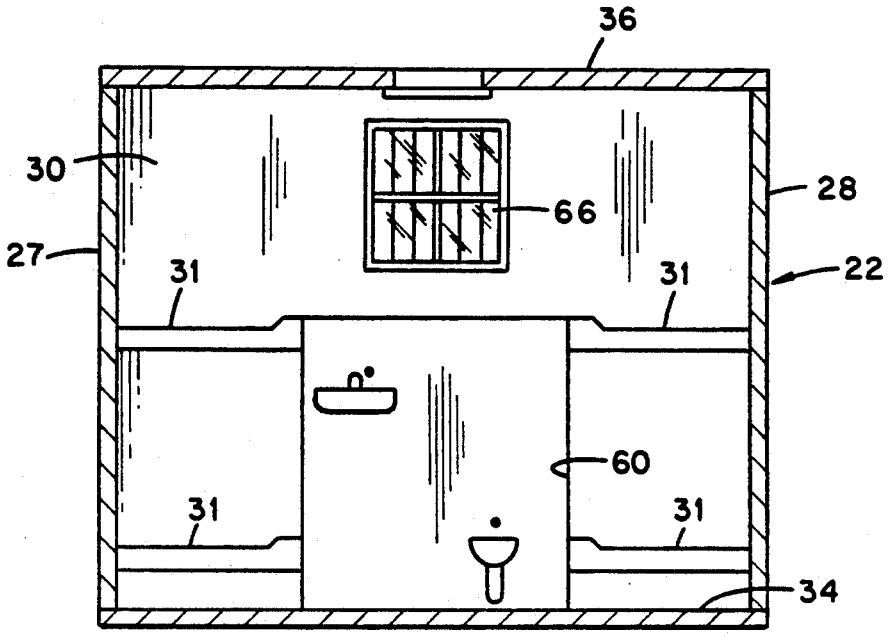
FIG. 7 is a cross-sectional view taken about along line 7—7 of FIG. 5.

With reference to FIGS. 5–9, each jail cell 22 is cubic in form and includes two opposite sidewalls 27, 28, a back wall 30, a front wall 32, a floor 34 and a top, or ceiling 36. Each of the sidewalls 27, 28 and floor 34 is solid over its entire surface area and is preferably constructed of pre-formed concrete. The ceiling 36 includes a central opening 38 of relatively rectangular cross-section as shown in FIGS. 4 and 6, and is solid over the remainder of its surface area. As will be apparent herein, the central opening 38 provides, in part, a vent opening 39 through which air of a controlled temperature is routed to the interior of the cell 22 and also provides an opening within which a light 41 is mounted. The top 36 is also preferably constructed of pre-formed concrete. In the depicted cell 22, bunks accommodations are provided for four individuals, with two bunks 31 supportedly attached to each sidewall 27 or 28.

Figure 5A:
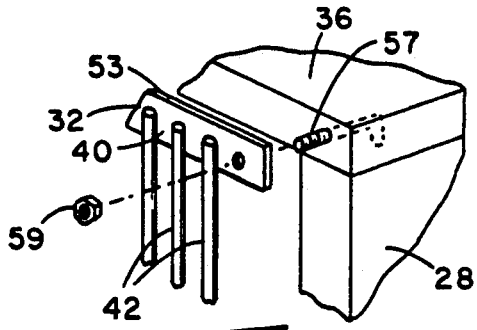
FIG. 5*a* is a perspective view of a fragment of the FIG. 5 cell, shown exploded.

As best shown in FIG. 5, the front wall 32 includes a major section 40 comprised of a plurality of vertically-extending bars 42 and door means 44 attached to the major section 40 for providing access to the cell interior. The bars 42 are joined to one another with horizontally-extending plates 53, 55 positioned adjacent the upper and lower ends of the bars 42. As exemplified by the arrangement illustrated in FIG. 5*a*, the front wall 32 is joined to the remainder of the cell 22 with threaded lugs 57 embedded within the cell top 36 for receipt by suitable openings provided in the plates 53, 55 and with nuts 59 positionable upon the lugs 57.

In the depicted cell 22, and with reference again to FIG. 5, the front wall 40 includes a pair of laterally-extending upper and lower guide tracks 46, 48, respectively, and the door means 44 includes a door 50 which is slidably positioned within the guide tracks 46, 48 for lateral movement therealong between opened and closed positions. Preferably, a reversible electric motor 52 is mounted on top of the cell 22, and is suitably connected to the door 50 so that rotation of the shaft of the motor 52 in one rotational direction moves the door 50 to its opened position and so that rotation of the shaft of the motor 52 in the opposite rotational direction moves the door 50 to its closed position. The motor 52 may be wired to a central control station 56 (FIG. 1) situated within the office area 24 so that the opening and closing of the door 50 may be controlled from within the office area. As best shown in FIG. 5, the door 50 includes a plurality of vertically-extending bars 58.

Figure 10:
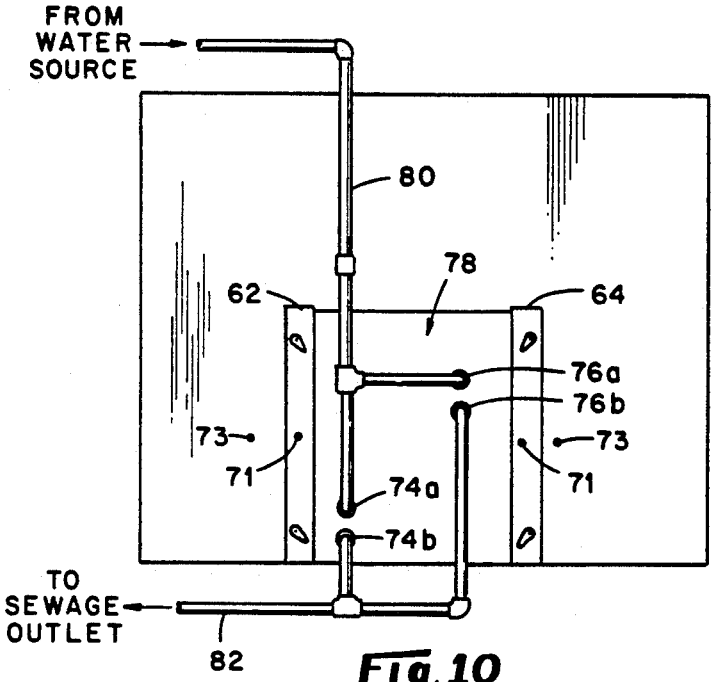
FIG. 10 is a back elevation view of the FIG. 5 cell and illustrating water and sewage piping routed thereto.

It is a feature of the present invention that each cell 22 include a facility unit 70 which can be removed from the cell 22 for replacement or repair. In this connection and with reference to FIGS. 8–10, the back wall 30 includes a rectangular opening 60 and a latch assembly 61 including two locking plates 62, 64 positioned on opposite sides of the opening 60. Each locking plate 62 or 64 is movable between a lock position, as illustrated in solid lines in FIG. 8, and a release position, as illustrated in phantom in FIG. 8, by means of a lever arm 65. The lever arm 65 is selectively connectable to the locking plate 62 or 64 by means of an aperture 71 provided in the plate 62 or 64 and the back wall 30 to by means of an aperture 73 provided in the back wall 30 adjacent the plate 62 or 64. By connecting the arm 65 to one of plates 62 and 64 and corresponding back wall aperture 73 and pivotally moving the arm 65 between its FIG. 8 solid-line position and its FIG. 8 phantom-line position, the plate 62 or 64 is moved between its lock and release positions. Each plate 62 or 64 is connected to the back wall 60 by a pair of headed pins 94 joined to the back wall 60 and extending through camming slots 96 provided in each plate 62 or 64, and the camming slots 96 accommodate the movement of each plate 62 or 64 between its lock and release positions.

Figure 8:
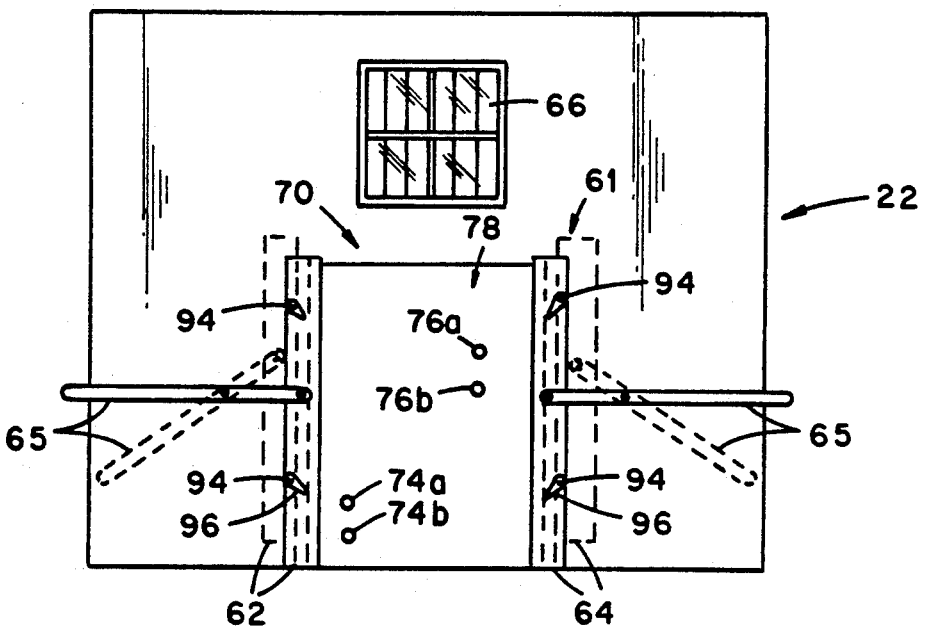
FIG. 8 is a back elevation view of the FIG. 5 cell.
Figure 9:
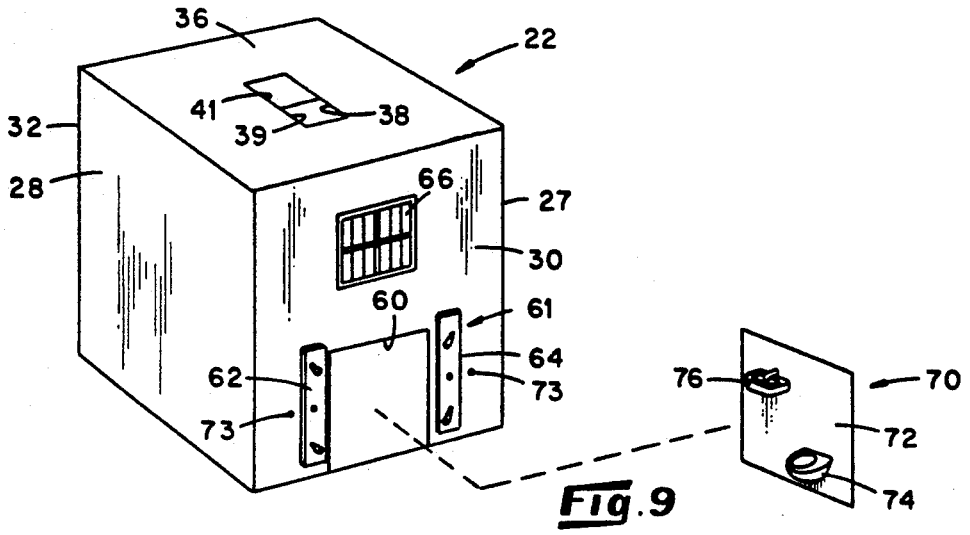
FIG. 9 is a perspective view, shown exploded, of the FIG. 5 cell.

The back wall 30 is constructed of pre-formed concrete and, if desired, may be formed with a window 66 positioned above the opening 60. The facility unit 70 includes a rectangular, two-sided panel 72 which is positionable into place between the locking plates 62, 64 and the edges of the opening 60 for covering the opening 60 and two lavatory facilities supportedly attached to the panel 72 so as to extend from one side thereof. In the depicted cell 22, the lavatory facilities include a toilet 74 and a sink 76 supportedly attached to one side of the panel 72. The unit 70 also includes appropriate connection means 78 (FIGS. 8 and 10) for connection of the toilet 74 and sink 76 in flow communication with a water source (not shown) and a sewage outlet (not shown) to the toilet 74 and sink 76. In the depicted cell 22, the connection means 78 includes couplings 74*a* and 76*a* for connection to suitable water piping 80 routed to the cell 22 and couplings 74*b* and 76*b* for connection to suitable sewage piping 82 routed to the cell 22. As best shown in FIG. 8, the coupling 74*a*, 74*b*, 76*a*, 76*b* are accessible on the side of the panel 72 opposite the lavatory facilities 74, 76.

To attach the facility unit 70 to the remainder of the cell 22 and with reference to FIG. 8, each of the locking plates 62, 64 is moved, with the aid of the lever arm 65, to its release position (or the FIG. 8 phantom-line position) and the panel 72 is positioned across the opening 60 so that the facilities 74 and 76 extend into the cell interior through the opening 60. Each locking plate 62 and 64 is thereafter returned to its lock position (or the FIG. 8 solid-line position) to thereby lock the panel 72 into place about the periphery of the opening 60 as its edges are secured between the locking plates 62, 64 and the back wall 30. To remove the panel 72 from the back wall 30, each locking plate 62, 64 is appropriately moved, with the lever arm 65, to the unlock position, and the panel 72 is moved away from the opening 60.

Upon securement of the facility unit 70 into place, the water piping 80 (FIG. 10) leading from the water source and the sewage piping 82 leading from the sewage outlet are hooked to the corresponding coupling members 74*a*, 74*b*, 76*a*, 76*b* to render the facilities 74, 76 operable.

A significant advantage provided by the cell 22 relates to the maintenance of the facility unit 70 external of the cell 22. The coupling members 74*a*, 74*b*, 76*a*, 76*b* are accessible from the exterior of the cell 22 enabling repairs to be made thereto without removal of the unit 70 from the cell 22. If, on the other hand, the toilet 74 or sink 76 becomes damaged or stopped-up so that repair to the facility-side of the panel 72 becomes necessary, the unit 70 may be removed for repair at a site remote of the cell 22. Such an advantage may be readily appreciated in view of the fact that since maintenance personnel are not required to enter the cell 22 within which a dangerous inmate may be confined, the maintenance personnel are not exposed to a danger that the inmate may present.

Figure 11:
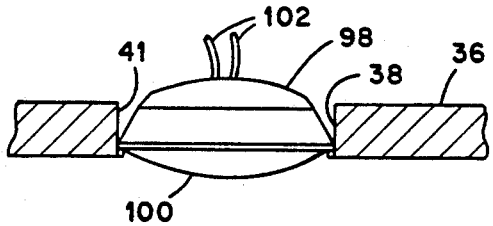
FIG. 11 is a fragmentary cross-sectional view taken about along line 11—11 of FIG. 2.

As mentioned earlier, part of the opening 38 provided in the ceiling 36 provides a vent opening 38 through which air of a controlled temperature is delivered to the cell interior. To this end and with reference again to FIG. 2, there is shown the ductwork 88 of a ventilation system 90 for the facility 20 including conduit sections 92 having ends which terminate adjacent each opening 39 provided therein. The remainder of the ceiling opening 38 supportedly accepts a light 41 positioned therein. As best shown in FIG. 11, the light 41 includes a fixture 98 and a cover 100 suitably supported within the part 41 of the opening 38. Electrical power is supplied to the light 41 by means of wires 102 extending from the fixture 98. Since the wires 102 and fixture 98 are accessible above the cell 22, there is no need to enter the cell 22 in order to make repairs to the light 41, and the cell 22 provides a further advantage in this respect.

Figure 12:
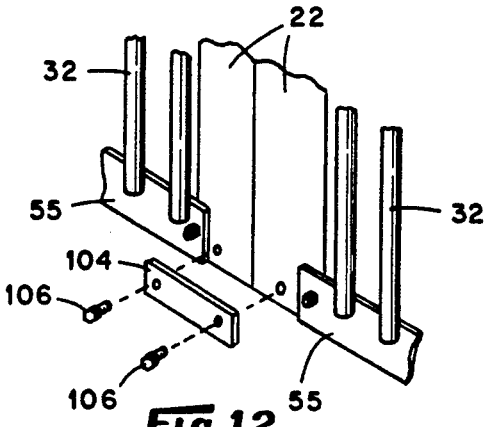
FIG. 12 is a fragmentary perspective view, shown exploded, attached and adjacent cells possessing a construction like that of the FIG. 5 cell.

Because each jail cell 22 is modular in construction, each cell 22 may be used by itself or grouped together with cells of like construction, as desired. The cells 22 are of sufficiently strength so that they can be stacked upon one another for storage, and because of the modular construction of each cell 22, additional cells 22 may be added to an existing arrangement of cells 22 to enlarge the capacity of the security facility 20 within which the cell arrangement is used. Alternatively, a cell 22 (or cells 22) may be removed from a security facility 20 to reduce the capacity of the facility 20. As illustrated in FIG. 12, adjacent cells 22 may be attached to one another by a plate 104 suitably secured, as with bolts 106, to the cells 22, 22 to thereby bind the cells 22, 22 together.

It will be understood that numerous modifications and substitutions may be had to the aforedescribed embodiment without from departing from the spirit of the invention. For example, although the door 5 of each of the cells 22 has been shown and described as movable along a horizontal path between its opened and closed conditions, a cell 22 in accordance with the broader aspects of this invention may include a door which is movable vertically between its opened and closed conditions. Furthermore, although the cells 22 in the facility 20 have been shown and described as being arranged in two rows, the cells 22 may be arranged in alternative arrangements such as circular, a horseshoe-shaped arrangement or superposed upon one another in a multistory structure. If used in a multi-story structure, a web-framed floor joist may be positioned atop the cells 22 to accommodate a multi-decked arrangement of the cells 26. Accordingly, the aforedescribed embodiment is intended for the purpose of illustration and not as limitation.

I claim:

1. A modular jail cell including:

means providing a front wall including a door providing access into and out of the interior of the cell, two opposite sidewalls, a back wall, a floor, a ceiling; and a facility unit including a two-sided panel, at least one lavatory facility supportedly attached to one side of the panel and connection means associated with the lavatory facility for operatively joining the lavatory facility to water and sewage piping routed to the cell, the connection means being accessible from the side of the panel opposite said one panel side; and at least one of the sidewalls and back wall including an opening across which the panel of the facilities unit is removably securable so that when the panel is secured across the opening, the lavatory facility is situated within the interior of the cell and the connection means are accessible from the exterior of the cell, and the panel of the facility unit is securable to said one of the sidewalls and back wall from the exterior of the cell to obviate the need to enter the cell interior to remove or replace the facility unit.

2. The cell as defined in claim 1 wherein the opening across which the panel of the facility unit is positionable is provided in the back wall.

3. The cell as defined in claim 1 wherein the panel of the facility unit is positioned in a predetermined location adjacent said one of the sidewalls and back wall for securement of the panel across the opening thereof and the panel of the facility unit and said one of the sidewalls and back wall includes locking means for locking the panel in position across the opening.

4. The cell as defined in claim 3 wherein one of the panel and said one of the sidewalls and back wall includes a locking member which is movable between lock and unlock positions and the other of the panel and said one of the sidewalls and back wall includes means cooperable with the locking member for releasably locking the panel into position across the opening when the locking member is moved from its lock position to its unlock position.

5. The cell as defined in claim 4 wherein the locking means includes a pair of locking plates positioned on opposite sides of the opening and pivotally attached to the back wall for movement between an unlock position accommodating movement of the panel into and out of position adjacent the opening and a lock position at which the panel is secured between the locking plates and the back wall.

6. The cell as defined in claim 1 wherein the lavatory facility is one of a toilet and a sink.

7. The cell as defined in claim 1 wherein at least one of the ceiling and the back wall includes a vent opening through which the cell interior is ventilated.

8. The cell as defined in claim 1 wherein each of the sidewalls and back wall is solid in construction.

9. The cell as defined in claim 1 wherein the means providing ; the front wall includes a plurality of vertically-oriented bars extending between the floor and the ceiling.

10. The cell as defined in claim 9 wherein the means providing front wall includes a guide track assembly and the door is slidably mounted within the guide track assembly for movement of the door between opened and closed conditions.

11. The cell as defined in claim 1 including means accommodating the attachment of the cell to a cell of like construction in a side-by-side arrangement.

12. A modular cubic jail cell including means providing a front wall, a back wall, two opposite and parallel sidewalls, a floor spanning the cell interior at the bottom thereof, and a ceiling spanning the cell interior at the top thereof;

said front wall including a door providing access into and out of the cell interior;

said ceiling including a vent opening through which the cell interior is ventilated;

a facility unit including a two-sided panel, at least one of a toilet and a sink supportedly attached to one side of the panel, and connection means for connecting the one of the toilet and sink to water and sewage piping routed to the cell;

said back wall including an opening across which the panel of the facilities unit is removably securable so that when the panel is secured across the opening in the back wall, the lavatory facility is positioned within the interior of the cell and the connection means are accessible from the exterior of the cell.

13. The cell as defined in claim 12 wherein the panel of the facility unit is securable to said one of the sidewalls and back wall from the exterior of the cell to obviate the need to enter the cell interior to remove or replace the facility unit.

14. The cell as defined in claim 12 wherein the panel of the facility unit is positioned in a predetermined location adjacent said one of the sidewalls and back wall for securement of the panel across the opening thereof and the panel of the facility unit and said one of the sidewalls and back wall includes locking means for locking the panel in position across the opening in the back wall.

15. The cell as defined in claim 13 wherein the locking means includes a pair of locking plates positioned on opposite sides of the back wall opening and pivotally attached to the back wall for movement between an unlock position accommodating movement of the panel into and out of position adjacent the opening and a lock position at which the panel is secured between the locking plates and the back wall.

16. The cell as defined in claim 12 including means accommodating the attachment of the cell to a cell of like construction in a side-by-side arrangement.

17. A jail facility including a plurality of modular cells arranged in a side-by-side relationship, each of the modular cells including:

means providing a front wall including a door providing access into and out of the interior of the cell, two opposite sidewalls, a back wall, a floor, a ceiling; and a facility unit including a two-sided panel, at least one lavatory facility supportedly attached to one side of the panel and connection means associated with the lavatory facility for operatively joining the lavatory facility to water and sewage piping routed to the cell, the connection means being accessible from the side of the panel opposite said one panel side; and at least one of the sidewalls and back wall including an opening across which the panel of the facility unit is removably securable so that when the panel is secured across the opening, the lavatory facility is situated within the interior of the cell and the connection means are accessible from the exterior of the cell; and the panel of the facility unit is securable to said one of the sidewalls and back wall from the exterior of the cell to obviate the need to enter the cell interior to remove or replace the facility unit.

18. The facility as defined in claim 17 wherein each of the cells are secured adjacent an adjacent cell.

* * * * *